US005330821A

United States Patent [19]

Lo

[11] Patent Number: 5,330,821

[45] Date of Patent: Jul. 19, 1994

[54] DECORATIVE DEVICE FOR CONCEALING THE TOP OF CURTAINS AND CERTAIN FIXTURES

[75] Inventor: Wen-Hsiung Lo, Feng-Yuan City, Taiwan

[73] Assignee: New Paradise Enterprise Co., Ltd., Taichung Hsien, Taiwan

[21] Appl. No.: 56,904

[22] Filed: May 5, 1993

[51] Int. Cl.[5] ..... A47H 1/10

[52] U.S. Cl. ..... 428/120; 428/119; 248/265; 211/105.3; 211/105.4; 16/94 R

[58] Field of Search ..... 428/99, 119, 120; 248/265, 261, 262; 211/105.1, 105.3, 105.4, 94; 16/94 R

[56] References Cited

U.S. PATENT DOCUMENTS 4,824,062 4/1989 Wagner ..... 248/265

*Primary Examiner*—Alexander S. Thomas

*Attorney, Agent, or Firm*—Cushman, Darby & Cushman

[57] ABSTRACT

A decorative device for concealing the top of curtains and curtain fixtures includes a pair of fixing plates, a pair of L-shaped slide plates and first and second shielding plates. Each of the L-shaped slide plates has an elongated plate which is connected slidably to its respective fixing plate. Each of the fixing plates has two opposite hook members which prevents the elongated plate of the slide plate from being detached in a direction opposite to the sliding direction of the elongated plate. Each of the slide plates has a connecting plate which is connected to its respective shielding plate. Two L-shaped members are formed adjacent to the upper and lower sides of each of the connecting plates in order to form two receiving grooves which are adjacent to the upper and lower sides of each of the connecting plates. Each of the first and second shielding plates has inwardly curving upper and lower sides whose edges are received by the receiving grooves of the connecting plates. Therefore, the first and second shielding plates can be securely fastened to the slide plates.

2 Claims, 6 Drawing Sheets

DECORATIVE DEVICE FOR CONCEALING THE TOP OF CURTAINS AND CERTAIN FIXTURES

BACKGROUND OF THE INVENTION

1. Field of the Invention

This invention relates to a decorative device for concealing the top of curtains and certain fixtures, more particularly to a decorative device for concealing the top of curtains and curtain fixtures which has good structural strength.

2. Description of the Related Art

Conventionally, decorative devices are widely used for concealing the top of curtains and curtain fixtures. FIG. 1 shows a conventional decorative device for concealing the top of curtains and curtain fixtures which includes a pair of fixing plates (1), two L-shaped slide plates (2, 3) which are respectively and slidably mounted to the fixing plates (1), and first and second shielding plates (4, 5) which telescope with one another and are connected respectively to the L-shaped slide plates (2, 3). The first and second shielding plates (4, 5) are made of a plastic material. Each of the fixing plates (1) has perpendicularly extending mounting plates (1*a*) with a plurality of fixing holes (1*d*). Fastening members (F) such as nails, screws, etc., pass through the positioning holes (1*d*) in order to affix the fixing plates (1) to the wall (W) where the top of curtains and curtain fixtures (not shown) are mounted, as best illustrated in FIG. 2. The fixing plates (1) are thus perpendicularly projected from the wall (W). Each of the fixing plates (1) has two sliding rails (1*b*) extending perpendicularly and respectively from the upper and lower edges of the fixing plates (1).

Each of the L-shaped slide plates (2, 3) has an elongated plate (2*d*) [(3*d*)] which engages respectively and slidably the respective fixing plate (1) between the two rails (1*b*) of one of the fixing plates (1). Each of the elongated plates (2*d*, 3*d*) has a connecting plate (2*a*) [(3*a*)] extending perpendicularly therefrom. Each of the connecting plates (2*a*, 3*a*) has two outward expanding resilient members (2*b*) [(3*b*)] at the upper and lower sides of the connecting plates (2*a*, 3*a*). Screw members (6) pass through elongated slots (1*c*) that are formed in the fixing plates (1) and threaded with the threaded holes (2*c*, 3*c*) which are respectively formed in the elongated plates (2*d*, 3*d*) of the slide plates (2, 3). Therefore, the slide plates (2, 3) can be set at a predetermined position relative to the fixing plates (1).

Each of the shielding plates (4, 5) has inwardly curving upper and lower sides (4*a*) [(5*a*)] and has first and second ends (4*b*, 4*c*) [(5*b*, 5*c*)] which connect with the upper and lower sides (4*a*) [(5*a*)], respectively. The first shielding plate (4) is slightly wider than the second shielding plate (5). The inwardly curving upper and lower sides (5*a*) of the second shielding plate (5) are received respectively by the inwardly curving upper and lower sides (4*a*) of the first shielding plate (4). The resilient members (2*b*, 3*b*) of the connecting plates (2*a*, 2*b*) are received respectively by the inwardly curving upper and lower sides (4*a*) of the first end (4*b*) of the first shielding plate (4) and the inwardly curving upper and lower sides (5*a*) of the second end (5*c*) of the second shielding plate (5). The resilient members (2*b*, 3*b*) retain frictionally and resiliently the first and second shielding plates (4, 5) to the connecting plates (2*a*, 3*a*).

The conventional decorative device suffers from the following disadvantages:

(1) The contact areas of the connecting plates (2*a*, 3*a*) and the first and second shielding plates (4, 5) are small, therefore the frictional engaging force between the connecting plates (2*a*, 3*a*) and the second shielding plates (4, 5) is small. The slide plates (2, 3) is prone to detaching from the first and second shielding plates (4, 5).

(2) Since the overall length of the first and second shielding plates (4, 5) is much longer than that of elongated plates (2*d*, 3*d*) of the sliding plates (2, 3), a great torque force is exerted on the elongated plates (2*d*, 3*d*) due to the weight of the first and second shielding plates (4, 5). The engaging force of the screw members (6) is usually not sufficient to prevent the detachment of the elongated plates (2*d*, 3*d*) from detaching from the fixing plates (1) in a direction transverse to the sliding direction of the elongated plates (2*d*, 3*d*) along the rails (1*b*). Therefore, the elongated plates (2*d*, 3*d*) are liable to separate from the fixing plates (1), as best illustrated in FIG. 2.

SUMMARY OF THE INVENTION

It is therefore a main object of this invention to provide a decorative device for concealing the top of curtains and curtain fixtures in which the connecting plates of the slide plates and the shielding plates engage securely with one another.

It is another object of this invention to provide a decorative device for concealing the top of curtains and curtain fixtures in which the slide plates are prevented from being disengaged from the fixing plate in a direction which is transverse to the sliding direction of the slide plates.

Accordingly, the decorative device for concealing the top of curtains and curtain fixtures of this invention, comprises:

a pair of fixing plates, each of the fixing plates having two sliding rails extending perpendicularly and respectively from an upper edge and a lower edge thereof which are opposite to one another;

a pair of L-shaped slide plates, each having an elongated plate which engages respectively and slidably with the respective fixing plate between the two rails of one of the fixing plates, each of the elongated plates having a .connecting plate extending perpendicularly therefrom, each of the connecting plates having an upper side and a lower side which are opposite to one another;

first and second elongated shielding plates having a uniform thickness, each of the first and second shielding plates having inwardly curving upper and lower sides which are opposite to one another and first and second ends which interconnect the upper and lower sides, respectively, the first shielding plate being wider than the second shielding plate so as to allow the first end of the second shielding plate to be telescoped with the second end of the first shielding plate, the inwardly curving upper and lower sides of the second shielding plate being received respectively by the inwardly curving upper and lower sides of the first shielding plate, the upper and lower sides of the connecting plates being received respectively in the inwardly curving upper and lower sides of the first end of the first shielding plate and the inwardly curving upper and lower sides of the second end of the second shielding plate; and means for retaining the first and second shield plates to the connecting plates;

the retaining means including two L-shaped members fixed adjacent to the upper and lower sides of each of the connecting plates, respectively, each of the L-shaped members having a vertical plate and a horizontal plate, each of the horizontal plates having two opposite sides connected perpendicularly and respectively to the vertical plate and one of the connecting plates so that a receiving groove is formed between each of the vertical plates of the L-shaped members and each of the connecting plates, each of the receiving grooves having a width which is substantially identical to the thickness of the inwardly curving upper and lower sides of the first and second shielding plates, the edges of the inwardly curving upper and lower sides which are adjacent to the first end of the first shielding plate and the second end of the second shielding plate are respectively received by the receiving grooves of the connecting plates.

Other features and advantages of this invention will become apparent in the following detailed description of the preferred embodiment of this invention with reference to the accompanying drawings.

DETAILED DESCRIPTION OF THE PREFERRED EMBODIMENT

Figure 1:
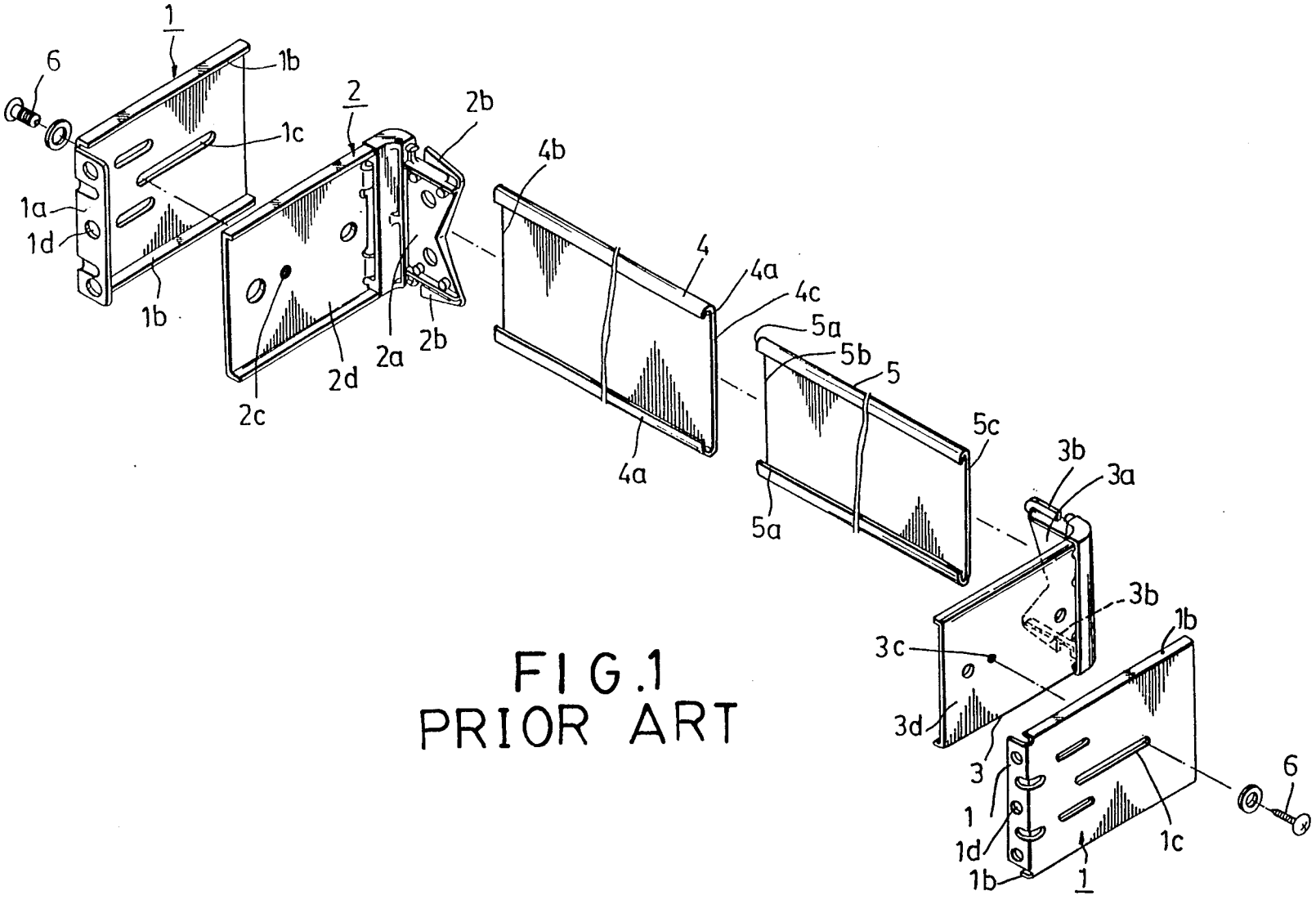
FIG. 1 PRIOR ART
FIG. 1 is a perspective exploded view of a conventional decorative device for concealing the top of curtains and curtain fixtures.
Figure 2:
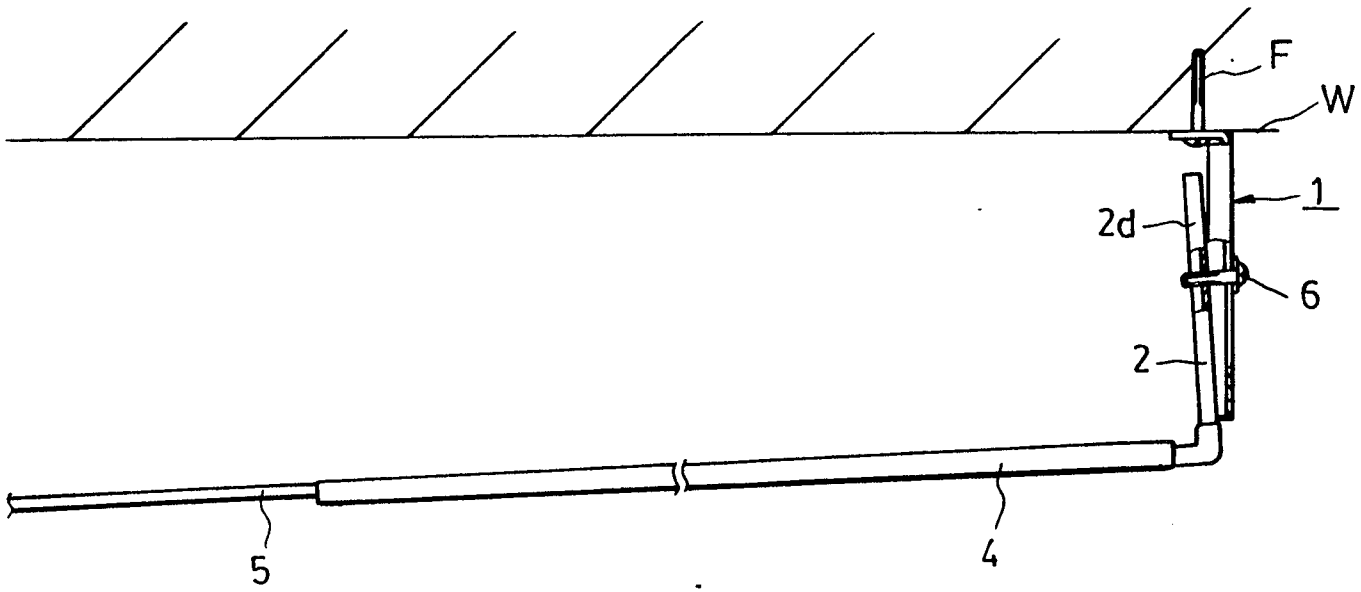
FIG. 2 PRIOR ART
FIG. 2 is a partial schematic top view of the conventional decorative device illustrating the disengagement of one of the slide plates from the fixing plate.
Figure 3:
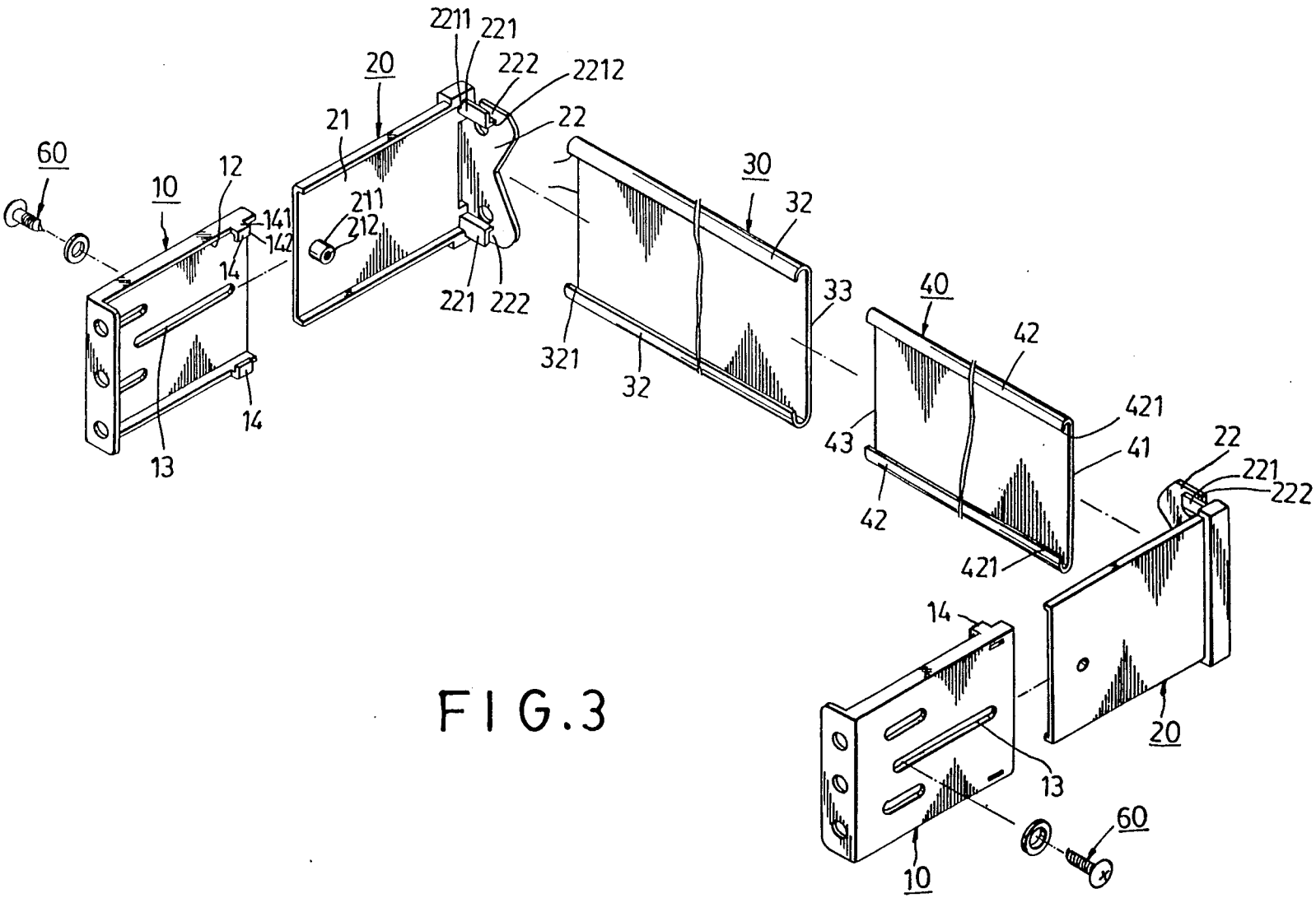
FIG. 3 is a perspective exploded view of the preferred embodiment of a decorative device for concealing the top of curtains and curtain fixtures of this invention.

FIG. 3 shows a preferred embodiment of a decorative device for concealing the top of curtains and curtain fixtures which comprises a pair of fixing plates (10), a pair of L-shaped slide plates (20) and first and second shielding plates (30, 40). The structure of the fixing plates (10), slide plates (20) and the first and second shielding plates (30, 40) of this invention are quite similar to that of the aforementioned fixing plates, slide plates and first and second shielding plates of the prior art. Therefore, for the purpose of simplification, the similar parts of the decorative device of this invention and the prior art will not be described in details.

Figure 4:
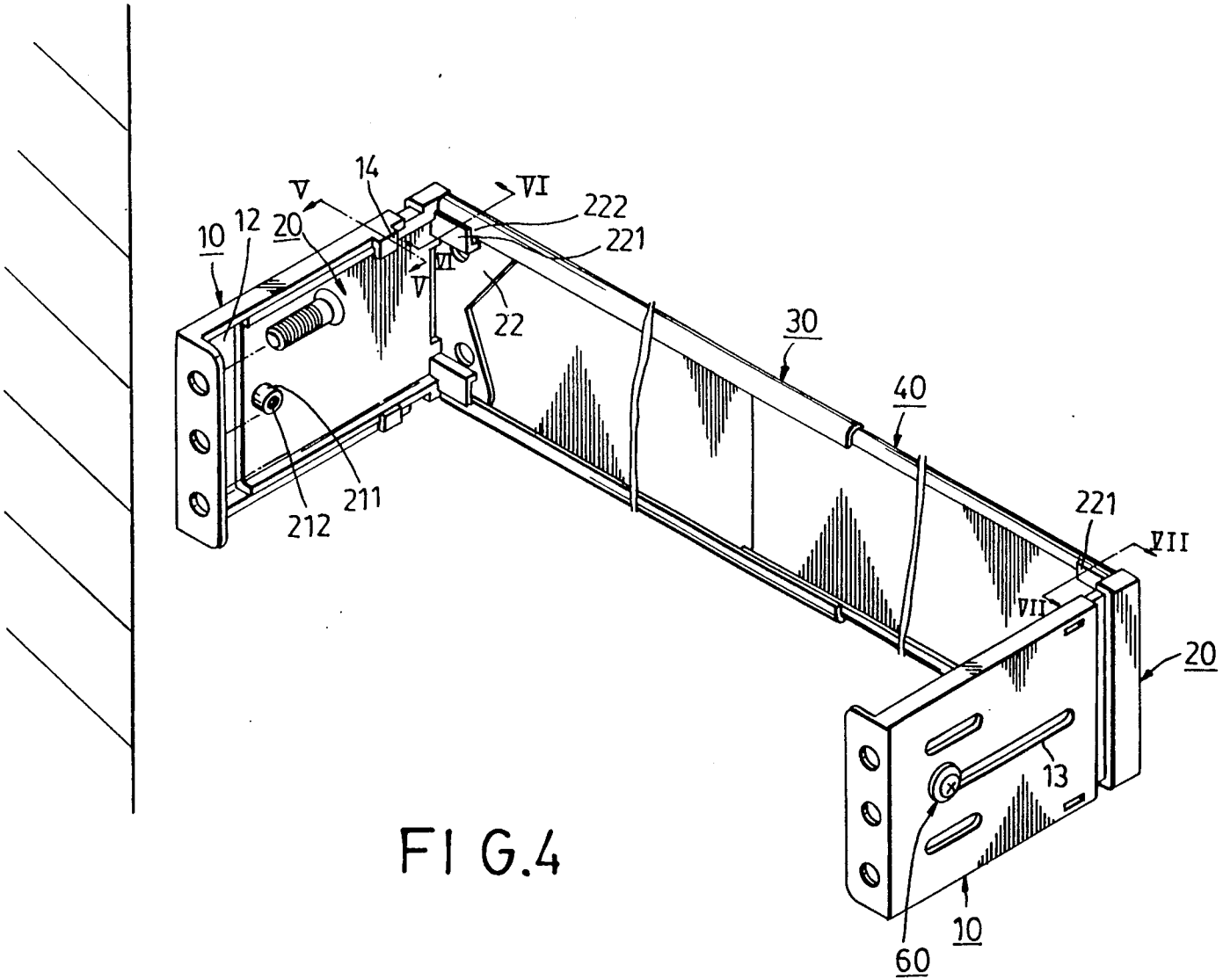
FIG. 4 is a perspective view of the preferred embodiment of the decorative device of this invention.
Figure 5:
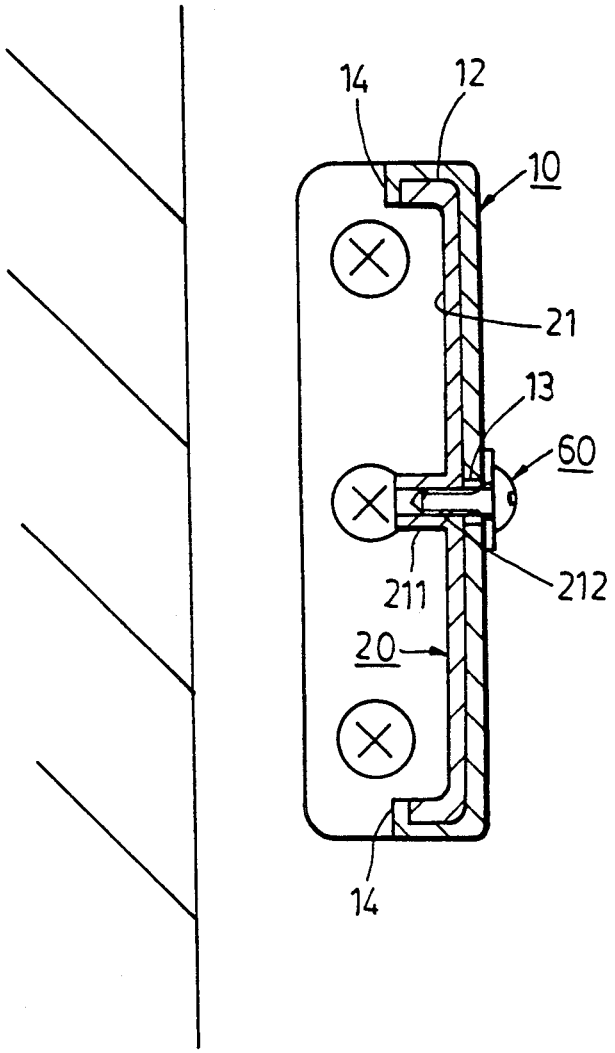
FIG. 5 is a cross sectional view taken along the lines V—V of FIG. 4.

Referring to FIGS. 3 and 4, the fixing plates (10) of this invention are distinct from that of the prior art only in that each of the sliding rails (12) of the fixing plates (10) has two L-shaped hook members (14) which are opposite to one another. Each of the hook members (14) has a horizontal portion (141) extending respectively from the longitudinal side of the rail (12) and a vertical portion (142) extending toward the other one of the vertical portions (142). Therefore, the elongated plates (21) of the slide plates (20) are prevented from being disengaged from the fixing plates (10) in a direction opposite to the lengthwise direction along which the elongated plates (20) move. When the decorative device of this invention is assembled, each of the slide plates (20) can be positioned with respect to the fixing plate by means of the screw members (60), each of which passes through an elongated slot (13) formed in the fixing plate (10) and then threaded into a threaded hole (212) of a stud (211) formed on the elongated plate (21) of the slide plate (20), as best illustrated in FIG. 5.

Figure 6:
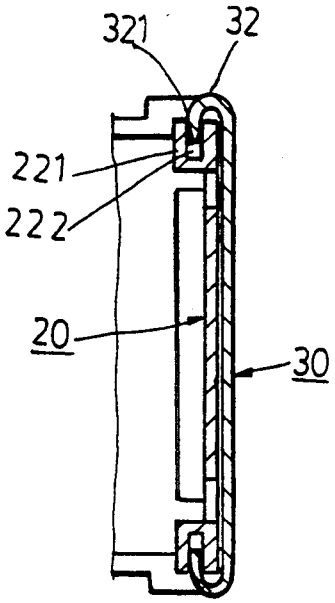
FIG. 6 is a cross sectional view taken along the lines VI—VI of FIG. 4.
Figure 7:
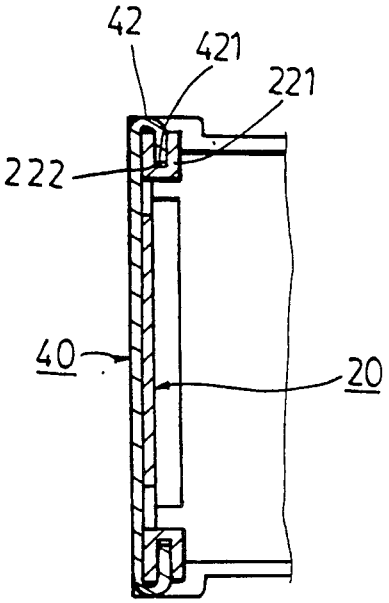
FIG. 7 is a cross sectional view taken along the lines VII—VII of FIG. 4.

The L-shaped slide plates (20) are distinct from those of the prior art in that the resilient members of the prior art are eliminated in this invention and each of the connecting plates (22) has two L-shaped members (221) which are fixed respectively and adjacent to the upper and lower sides of each of the connecting plates (22). Each of the L-shaped members (221) has a vertical plate (2211) and a horizontal plate (2212). Each of the horizontal plates (2212) has two opposite sides connected perpendicularly to the vertical plate (2211) and one of the connecting plates (22), respectively, so that a receiving groove (222) is formed between each of the vertical plates (2211) of the L-shaped members (221) and each of the connecting plates (22). The structure of the first and second shielding plates (30, 40) are the same as that of the first and second shielding plates of the prior art and the first and second shielding plates (30, 40) have inwardly curving upper and lower sides (32, 42). The width of each of the receiving grooves (222) is substantially identical to the thickness of the inwardly curving upper and lower sides (32) of the first shielding plate (30) and the inwardly curving upper and lower sides (42) of the second shielding plates (40). When assembled, the first end (43) of the second shielding plate (40) and the second end (33) of the first shielding plate (30) telescope with one another. The upper and lower sides of the connecting plates (22) are respectively received by the inwardly curving upper and lower sides (32, 42) which are respectively adjacent to the first end (31) of the first shielding plate (30) and the second end (41) of the second shielding plate (40). The edges (321, 421) of the inwardly curving upper and lower sides (32, 42) which are adjacent to the first end (31) of the first shielding plate (30) and the second end (41) of the second shielding plate (40), respectively, are received in the receiving grooves (222) of the connecting plates (22), as best illustrated in FIGS. 6 and 7. It is noted that the contact area of the inwardly curving upper and lower sides (32, 42) of the first and second shielding plates (30, 40) and the L-shaped members 221 is much greater than that of the inwardly curving upper and lower sides of the first and second shielding members of the prior art. Therefore, the first and second shielding plates (30, 40) of the decorative device of this invention can be connected to the connecting plates (22) more securely than in the case of the prior art.

With this invention thus explained, it is apparent that numerous modifications and variations can be made without departing from the scope and spirit of this invention. It is therefore intended that this invention be limited only as indicated in the appended claims.

I claim:

1. A decorative device for concealing the top of curtains and curtain fixtures, said decorative device comprising:

a pair of fixing plates, each of said fixing plates having two sliding rails extending perpendicularly from an upper edge and a lower edge thereof which are opposite to one another;

a pair of L-shaped slide plates, each having an elongated plate which engages slidably with the respective fixing plate between said two rails of one of said fixing plates, each of said elongated plates having a connecting plate extending perpendicularly therefrom, each of said connecting plates having an upper side and a lower side which are opposite to one another;

first and second elongated shielding plates having a uniform thickness, each of said first and second shielding plates having inwardly curving upper and lower sides which are opposite to one another and first and second ends which connect with said upper and lower sides, respectively, said first shielding plate being wider than said second shielding plate so that said first end of said second shielding plate can be telescoped with said second end of said first shielding plate with said inwardly curving upper and lower sides of said second shielding plate being received by said inwardly curving upper and lower sides, respectively, of said first shielding plate, said upper and lower sides of said connecting plates being received respectively in said inwardly curving upper and lower sides of said first end of said first shielding plate and said inwardly curving upper and lower sides of said second end of said second shielding plate; and means for retaining said first and second shield plates to said connecting plates; the improvements comprising:

said retaining means including two L-shaped members fixed adjacent to said upper and lower sides of each of said connecting plates, respectively, each of said L-shaped members having a vertical plate and a horizontal plate, each of said horizontal plates having two opposite sides connected perpendicularly to its respective vertical plate and one of said connecting plates so that a receiving groove is formed between each of said vertical plates of said L-shaped members and its connecting plates, each of said receiving grooves having a width which is substantially identical to the thickness of said inwardly curving upper and lower sides of said first and second shielding plates so as to allow edges of said inwardly curving upper and lower sides, said edges of said inwardly curving upper and lower sides being adjacent to said first end of said first shielding plate and said second end of said second shielding plate and which are received by said receiving grooves of the connecting plates, respectively.

2. A decorative device as claimed in claim 1, wherein each of said sliding rails have two hook members which extend respectively therefrom and which are opposed to one another in order to prevent said elongated plates of said slide plates from being disengaged from said fixing plates in a direction opposite to a lengthwise direction along which said elongated plates move.

* * * * *